US010436483B2

(12) United States Patent
Yu

(10) Patent No.: US 10,436,483 B2
(45) Date of Patent: Oct. 8, 2019

(54) HEAT EXCHANGER FOR MICRO CHANNEL

(71) Applicant: Shaoming Yu, Zhenjiang (CN)

(72) Inventor: Shaoming Yu, Zhenjiang (CN)

( * ) Notice: Subject to any disclaimer, the term of this patent is extended or adjusted under 35 U.S.C. 154(b) by 530 days.

(21) Appl. No.: 14/423,048

(22) PCT Filed: Jul. 25, 2013

(86) PCT No.: PCT/CN2013/080096
§ 371 (c)(1),
(2) Date: Feb. 20, 2015

(87) PCT Pub. No.: WO2014/032488
PCT Pub. Date: Jun. 3, 2014

(65) Prior Publication Data

US 2015/0219375 A1 Aug. 6, 2015

(30) Foreign Application Priority Data

Aug. 30, 2012 (CN) ..... 2012 1 0315505
Aug. 30, 2012 (CN) ..... 2012 1 0315518

(51) Int. Cl.
*F28D 1/053* (2006.01)
*F28F 9/02* (2006.01)
*F25B 39/02* (2006.01)

(52) U.S. Cl.
CPC ..... *F25B 39/028* (2013.01); *F28D 1/05366* (2013.01); *F28F 9/026* (2013.01);
(Continued)

(58) Field of Classification Search
CPC ..... F28D 1/05366; F28F 9/0246; F28F 9/026; F28F 9/0275; F28F 9/0273; F28F 2009/0285; F28F 2260/02; F25B 39/028
See application file for complete search history.

(56) References Cited

U.S. PATENT DOCUMENTS 5,597,037 A * 1/1997 Asada ..... F25B 39/00 165/110
5,619,861 A 4/1997 Yamanaka et al.
(Continued)

FOREIGN PATENT DOCUMENTS

CN 101509732 A 8/2009
CN 101520282 A 9/2009
(Continued)

OTHER PUBLICATIONS

First Office Action in Chinese Patent Application No. 201210315518.5, dated Aug. 2, 2016.
(Continued)

*Primary Examiner* — Frantz F Jules
*Assistant Examiner* — Martha Tadesse
(74) *Attorney, Agent, or Firm* — Venable LLP; Henry J. Daley

(57) ABSTRACT

A micro-channel heat exchanger includes a first header, a second header, multiple sets of flat pipes, and a distributor disposed outside of the first header. The distributor is provided with at least one main outlet and at least one secondary outlet. The first header is provided with at least one main fluid port connected to the main outlet of the distributor through a main connecting pipe. The first header or the second header is provided with a secondary fluid port. The secondary outlet of the distributor is connected to the secondary fluid port through a secondary connecting pipe, and a height of the position where the distributor is located is greater than a height of the first header.

11 Claims, 11 Drawing Sheets

(52) U.S. Cl.
CPC ..... *F28F 9/0246* (2013.01); *F28F 9/0273* (2013.01); *F28F 9/0275* (2013.01); *F28F 2009/0285* (2013.01); *F28F 2260/02* (2013.01)

(56) References Cited

U.S. PATENT DOCUMENTS

| | | | | |
|---|---|---|---|---|
| 6,073,858 | A * | 6/2000 | Obara | B60H 1/00328 237/12.3 B |
| 6,155,075 | A * | 12/2000 | Hanson | F25B 39/02 62/509 |
| 8,166,776 | B2 * | 5/2012 | Kopko | F25B 39/04 62/186 |
| 8,235,101 | B2 * | 8/2012 | Taras | F25B 13/00 165/101 |
| 9,499,026 | B2 * | 11/2016 | Brodie | B60H 1/00907 |
| 2003/0126883 | A1 * | 7/2003 | Saito | F25B 41/00 62/500 |
| 2006/0054310 | A1 | 3/2006 | Kim et al. | |
| 2008/0023185 | A1 | 1/2008 | Beamer et al. | |
| 2008/0104975 | A1 * | 5/2008 | Gorbounov | F25B 41/043 62/117 |
| 2008/0296005 | A1 * | 12/2008 | Taras | F25B 13/00 165/173 |
| 2010/0175862 | A1 * | 7/2010 | Franklin | F25J 1/0022 165/175 |
| 2011/0000255 | A1 | 1/2011 | Taras et al. | |
| 2014/0366574 | A1 | 12/2014 | Christians et al. | |

FOREIGN PATENT DOCUMENTS

| | | | |
|---|---|---|---|
| CN | 101858698 | A | 10/2010 |
| CN | 101865574 | A | 10/2010 |
| CN | 101900460 | A | 12/2010 |
| CN | 201954845 | U | 8/2011 |
| CN | 202013133 | U | 10/2011 |
| EP | 2362176 | A2 | 8/2011 |
| JP | H06159983 | A | 6/1994 |
| JP | H085195 | A | 1/1996 |
| JP | H11-294902 | A | 10/1999 |
| JP | 2008-196761 | A | 8/2008 |
| JP | 2008-196762 | A | 8/2008 |
| WO | 2009-152015 | A2 | 12/2009 |

OTHER PUBLICATIONS

Office Action in Chinese Patent Application No. 201210315505.8 dated Jul. 5, 2016.
International Search Report of PCT/CN2013/080096 dated Oct. 30, 2013 with an English translation.
Office Action issued in German Application No. 11 2013 004 284.3, dated Feb. 6, 2019.

* cited by examiner

HEAT EXCHANGER FOR MICRO CHANNEL

This application is the national phase of International Application No. PCT/CN2013/080096, titled "HEAT EXCHANGER FOR MICRO CHANNEL", filed on Jul. 25, 2013, which claims the benefit of priorities to Chinese Patent Application No. 201210315505.8 titled "MICRO-CHANNEL HEAT EXCHANGER", filed with the Chinese State Intellectual Property Office on Aug. 30, 2012, and Chinese Patent Application No. 201210315518.5 titled "MICRO-CHANNEL HEAT EXCHANGER", filed with the Chinese State Intellectual Property Office on Aug. 30, 2012. The entire disclosures of all applications are incorporated herein by reference.

TECHNICAL FIELD

The present application relates to the field of refrigeration control technique, and particularly to a micro-channel heat exchanger for air conditioners, such as automotive, household or commercial micro-channel evaporators.

BACKGROUND

In present, in the field of refrigeration control technique, more and more evaporators start to employ micro-channel heat exchangers to improve the heat exchange efficiency. The micro-channel heat exchanger generally includes two sets of headers, multiple sets of flat tubes arranged between the two sets of headers, fins arranged between the flat tubes, side boards, and etc. After being throttled and depressurized by an expansion valve, the refrigerant becomes gas-liquid two-phase state and then enters into the headers to be distributed into flat tubes, in the process of the refrigerant being distributed into the flat tubes, an inhomogeneous distribution of refrigerant may be generated between each flat tube. More refrigerant flow may be distributed into the flat tubes near two ends of the headers. Meanwhile since the refrigerant is in gas-liquid two-phase state, the inhomogeneous distribution of the refrigerant may be further aggravated due to the layered phenomenon of the gaseous refrigerant and the liquid refrigerant. A metal introducing tube is generally inserted in the header as a distribution tube to ensure a homogenous distribution of refrigerant in each flat tube of the micro-channel heat exchanger. The tube is inserted to a bottom of the header with its end sealed, and meanwhile grooves or holes are formed with a certain distance on an arc surface of the tube along the length direction, thus via these holes or grooves, the refrigerant can be uniformly distributed into each flat tube for circulation. In a solution disclosed in FIG. 13, a micro-channel heat exchanger includes two sets of headers 1', multiple sets of flat tubes 3' arranged between the two sets of headers 1' and fins arranged between the flat tubes 3', a distributor 2' is inserted into the header 1', and fluid is distributed to the flat tubes via multiples small holes arranged in the distributor 2'. In another technical solution, such as the technical solution disclosed in US20080023185, a metal flat plate is inserted into a header to separate the header to two fluid passages, and meanwhile holes or grooves are formed with a certain distance on a lateral surface of the flat plate along the length direction, thereby realizing the homogeneous distribution and collection of the refrigerant.

In both the above two technical solutions, each hole is used for distributing refrigerant into flat tubes in one area, with one hole corresponding to multiple flat tubes, thus the refrigerant flowing from the holes is distributed again in partial areas. Since the fluid passing through the distributor is a two-phase fluid, noises may be caused when the two-phase fluid enters into the header, and noises may also be caused when the fluid enters into the flat tubes. For air conditioners with the evaporator placed indoor, such noises are difficult to be accepted by users. In addition, in the above two technical solutions, it is required to perforate the distributor or the flat plate which is to be inserted into the header, thus due to the perforation structure, the technology is complicated and the requirement of machining accuracy is high. Besides, the sizes and intervals of the flow areas of the holes are required to be constantly debugged while debugging the distribution homogeneity, resulting in an overly long development period and a relatively higher development cost of the evaporator.

SUMMARY

A technical problem to be solved by the present application is to provide a micro-channel heat exchanger, which generates little noise in the fluid distributing process, is easy to assemble and debug, and can realize more homogenous distribution. In view of this, the following technical solutions are employed in the present application.

A micro-channel heat exchanger includes a first header located at a lower side, a second header located at an upper side, and a plurality of sets of flat tubes arranged between the first header and the second header, wherein the micro-channel heat exchanger further includes a distributor located outside of the first header, the distributor is provided with at least one main outlet disposed at a position close to a lower side thereof and at least one secondary outlet disposed at a position close to an upper side thereof, the first header is provided with at least one main flow opening, the main flow opening is connected to the main outlet of the distributor by a main connecting pipe, the micro-channel heat exchanger is provided with a secondary flow opening in the first header or the second header, the secondary flow opening is connected to the secondary outlet of the distributor by a secondary connecting pipe, and a position where the distributor is located is higher than a position where the first header is located.

A main body of the distributor is of a tubular structure which is horizontally arranged, the number of the main outlets is more than two, and all of the main outlets are arranged on one side lower than a centre of the main body of the distributor in a height direction; the first header is provided with main flow openings with a number same as the number of the main outlets of the distributor, and each main outlet is connected to the respective main flow opening by the respective main connecting pipe.

In addition, the main body of the distributor may be vertically arranged or obliquely arranged.

An axis of the main outlet of the distributor is oriented at an angle $\alpha$ with respect to an axis of the distributor in a vertical direction, and $60° \leq \alpha \leq 0°$; a center of the main flow opening of the first header is arranged at a position higher than a centre of the first header in a height direction, and the main flow opening is located between two adjacent flat tubes; and the main outlet and the main body of the distributor form an integrated structure by extrusion processing.

A main body of the distributor is of a tubular structure, and is vertically arranged or obliquely arranged, the main outlet of the distributor is arranged at a position lower than a center of the main body of the distributor in a height direction, and the secondary outlet of the distributor is arranged at a position higher than the center of the main body of the distributor in the height direction; the distributor is further provided with a first port connected to a system, and the first port is arranged at a lateral portion of a middle of the main body of the distributor; a height of the first port is higher than a height of the main outlet and lower than a height of the secondary outlet.

Both two ends or one of the two ends of the first header is provided with the main flow opening, the main outlet of the distributor is connected to the main flow opening at the end of the first header by the main connecting pipe, the height of the main outlet of the distributor is higher than a height of the main flow opening at the end of the first header; an axis of the main flow opening and an axis of the first header are arranged in parallel, or arranged perpendicular to each other, or arranged to form an angle ranging from 30 degree to 150 degree.

Optionally, the first header is divided by a partition into two sections, including a main header section and an auxiliary header section, wherein the main flow opening is arranged at the main header section and the secondary flow opening is arranged at the auxiliary header section of the first header, and a length of the main manifold section is more than six times a length of the auxiliary header section; the main header section and the auxiliary header section are respectively connected to the second header by flat tubes.

Further, the distributor is provided with the first port connected to the system, and the second header is provided with a second port connected to the system; a center of an inlet of the distributor, through which the first port is connected to the distributor, is higher than the center of the main body of the distributor in the height direction; and an interior equivalent diameter or an interior height D of the distributor and an interior equivalent diameter d of the main connect pipe satisfy an expression: $2 \leq D/d \leq 10$.

Further, the distributor is arranged in parallel with the first header and is provided with at least three main outlets, the main header section of the first header is provided with main flow openings with a number same as the number of the main outlets, and the main outlets and the main flow openings are respectively uniformly arranged at the distributor and the main header section of the first header in a horizontal direction.

Further, the secondary outlet is arranged at a top of the distributor, and in the secondary connecting pipe configured to connect the secondary outlet to the secondary fluid outlet of the first header, at least a part of the pipe has a height higher than that of the distributor, and the height of the part of the pipe that is higher than the distributor is greater than or equal to an inner diameter or an interior height D of the distributor.

The first header is not provided with a partition, the secondary flow opening is arranged on the second header, and the secondary outlet of the distributor is connected to the secondary flow opening of the second header by the secondary connecting pipe that is located at the upper side.

Further, the secondary flow opening is arranged at a middle of the second header, or at a position between the middle portion and another end of the second manifold that is far from the second port; and a one-way valve is provided in the secondary connecting pipe between the secondary outlet of the distributor and the secondary flow opening of the second header, and the one-way valve is opened in a direction from the secondary outlet to the secondary flow opening of the second header, and is blocked in a direction from the secondary flow opening of the second header to the secondary outlet of the distributor.

Further, the number of the main flow opening arranged on the first header is less than or equal to a half of the number of the flat tubes in communication with the main flow opening.

Therefore, in the present application, by arranging a distributor at an upper side outside of the header, and respectively arranging distributing outlets in two directions of upward direction and downward direction of the distributor, a ratio of gas in fluid flowing to the main outlet of the first header may be significantly decreased, thus when this part of fluid is distributed into the flat tubes, the noises may be further decreased, and the micro-channel heat exchanger may realize a more uniform distribution and more sufficient heat exchange. Further, due to such distributor, the distributor conventionally arranged inside the header is cancelled, which solves the problem that it is difficult to machine distribution holes on the distributor, and the machining of the parts is relatively easy and the assembling process is relatively simple.

DETAILED DESCRIPTION

For making the above objects, features and advantages of the present application more clear and easier to understand, embodiments of the present application are illustrated in detail in conjunction with drawings hereinafter.

Figure 1:
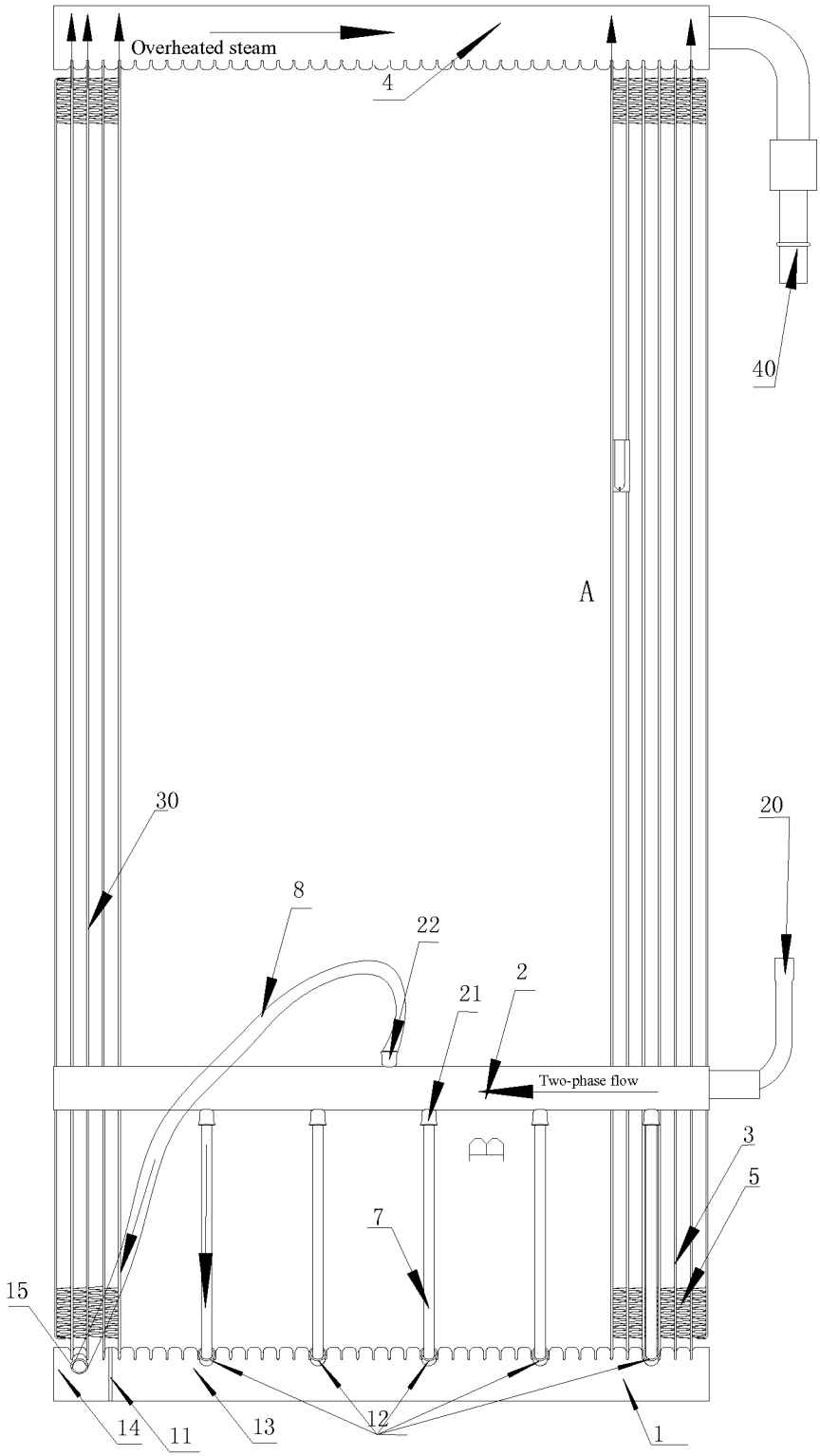
FIG. 1 is a schematic view showing the connection structure of a first embodiment of a micro-channel heat exchanger according to the present application.
Figure 2:
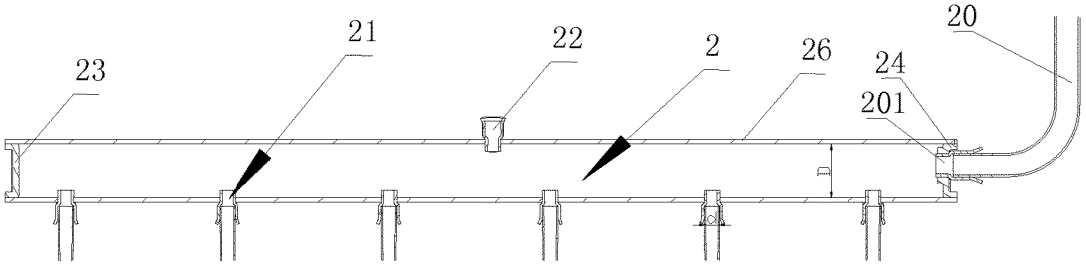
FIG. 2 is a transversely sectional schematic view showing the structure of a distributor of the micro-channel heat exchanger shown in FIG. 1.
Figure 3:
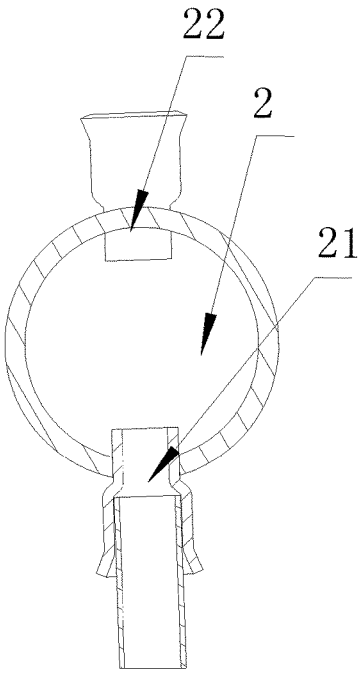
FIG. 3 is a transversely sectional schematic view showing the structure of the distributor shown in FIG. 2.

The first embodiment of the present application is shown in FIGS. 1 to 3. FIG. 1 is a schematic view showing the connection structure of the first embodiment of a micro-channel heat exchanger according to the present application, wherein the arrows in the Figure are used to indicate the flow direction of refrigerant when the micro-channel heat exchanger is used as an evaporator. FIG. 2 is a transversely sectional schematic view showing the structure of a distributor of the micro-channel heat exchanger shown in FIG. 1, and FIG. 3 is a transversely sectional schematic view showing the structure of the distributor shown in FIG. 2. The micro-channel heat exchanger includes a first header 1 located at a lower side, a second header 4 located at an upper side, multiple sets of flat tubes 3 arranged between the first header 1 and the second header 4, and multiple sets of fins 5 arranged between the flat tubes 3. For clearly showing other parts in the Figures, only partial flat tubes and fins are illustrated in the Figures. A second port 40 is connected to the second header 4, the first header 1 is divided by a partition 11 into two sections, including a main header section 13 and an auxiliary header section 14, and the main header section 13 is provided with more than two main flow openings 12, and the auxiliary header section 14 is provided with at least one secondary flow opening 15. A main body 26 of the distributor 2 is of a horizontally arranged tubular structure, and the main body 26 is embodied as a circular tube in this embodiment, but can also be embodied as a square tube or a tube of other geometry shapes. Multiple main outlets 21 with an equivalent number as the main flow openings 12 are arranged on the distributor 2 at positions close to a lower side, the main flow openings 12 are connected to the main outlets 21 by main connecting pipes 7, and in this way, the distributor 2 is connected to the main header section 13 of the first header 1. In addition, at least one secondary outlet 22 is arranged on the distributor 2 at a position close to an upper side, and is preferably arranged at the position of a top portion of the distributor 2 in the vertical direction, the secondary outlet 22 is connected to the secondary flow opening 15 of the auxiliary header section 14 of the first header 1 by a secondary connection pipe 8. A first end cover 23 and a second end cover 24 are respectively connected to two ends of the distributor 2 to seal the two ends.

An axial direction of a core of the heat exchanger is arranged vertically or obliquely upward, the distributor is horizontally arranged, and according to the embodiment in the Figures, the distributor 2 is arranged in parallel with the first header 1, a horizontal position of the distributor 2 is higher than a horizontal position of the first header 1, and a height difference between the distributor 2 and the first header 1 in the vertical direction is greater than or equal to an equivalent outer diameter of the distributor 2 and less than or equal to ten times of an outer diameter of the first header 1. The distributor 2 may be placed on a windward side, a leeside or a lateral side of the core A of the heat exchanger, which can be determined according to the installation spatial position. Multiple main outlets 21 of the distributor and multiple main flow openings 12 of the first header 1 are substantially distributed uniformly. In this way, when passing through the distributor, gas-liquid two-phase refrigerant flowing from the first port 20 may be separated in the distributor since the gravity of the liquid refrigerant is greater than that of the gaseous refrigerant, thus the liquid refrigerant is converged in a lower half of the distributor relatively concentratedly and the gaseous refrigerant is basically concentrated in an upper space. In this way, most of the gaseous refrigerant concentrates in the top portion of the distributor 2 and then enters into the auxiliary header section 14 of the first header 1 from the secondary outlet 22 on the top portion through the secondary connect pipe 8, and then are guided through a part of the flat tubes 30 to the second header 4 to be overheated (fins may be provided at an outer surface of the flat tubes to increase the heat exchange area). Under the action of the gravity, the liquid refrigerant enters into the main header section 13 of the first header 1 from multiple main outlets 21 on the lower end of the distributor 2 through the main connecting pipes 7, thus the refrigerant inside the main header section 13 is mainly liquid refrigerant, and the refrigerant distributed into the flat tubes 3 in communication with the main header section 13 is also mainly liquid refrigerant. Meanwhile, a partition 11 is provided to fully isolate the main header section 13 from the auxiliary header section 14 of the first header 1, so as to entirely separate the refrigerant in the main header section 13 from the refrigerant in the auxiliary header section 14, thus the problem of noises caused when the first header distributing refrigerant is solved. The liquid refrigerant and gaseous refrigerant each pass through respective route in the core of the heat exchanger to exchange heat, and are converged in the second header 4 and then flow out of the heat exchanger through the second port 40. Therefore, the effect of distributing the refrigerant uniformly can be realized, and meanwhile the problem of noises caused by the two-phase flow can also be overcame.

Figure 4:
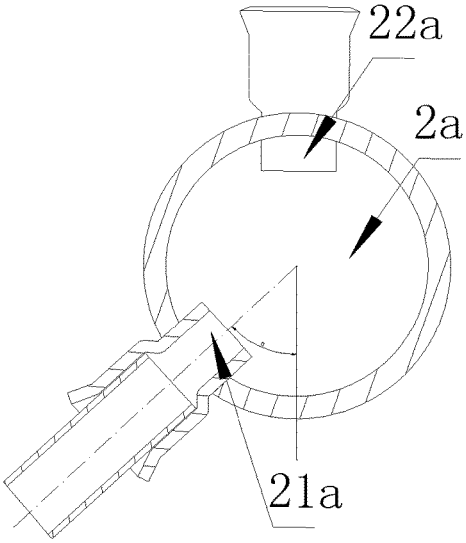
FIG. 4 is a transversely sectional schematic view showing the structure of another embodiment of the distributor according to the present application.

In this embodiment, the main outlets 21 of the distributor 2 are located at a lower side, but the present application is not limited to this. As shown in FIG. 4, FIG. 4 is a transversely sectional schematic view showing the structure of another embodiment of the distributor according to the present application, the main outlet 21*a* of the distributor 2*a* is arranged obliquely downward in this embodiment, specifically, an axis of the main outlet 21*a* and an axis of the distributor 2*a* in the vertical direction form an included angle $\alpha$, and $60° \leq \alpha \leq 0°$. In addition, the partition in the above embodiment is mainly used to completely isolate two kinds of fluids flowing from the distributor, and the position of the partition is changeable with the change of the refrigerating system, a length of the main header section is longer than a length of the auxiliary header section, and further, the length of the main header section may be more than six times the length of the auxiliary header section. Moreover, the number of the main connecting pipes 7 connected to the main header section is less than or equal to a half of the number of the flat tubes 3 connected to the main header section 13. Besides, the shape of a cross-section of the distributor preferably employs cylinder, but can also employ other various dimensional structures with regular or irregular shapes which are not cylinder, which can also realize the object of the present application. The main flow openings 12 connected to the main connecting pipe are generally uniformly provided on the lateral position of the main header section 13 of the first header 1 and are located between two adjacent flat tubes, thus the distribution effect is better. In addition, a center position of an inlet 201, through which the first port 20 is connected to the distributor 2, is higher than the position of a centerline of the distributor 2 in the height direction. An inner diameter or an inner height D of the distributor 2 and an inner diameter d of the main connecting pipe satisfy the expression: $2 \leq D/d \leq 10$.

Figure 2A:
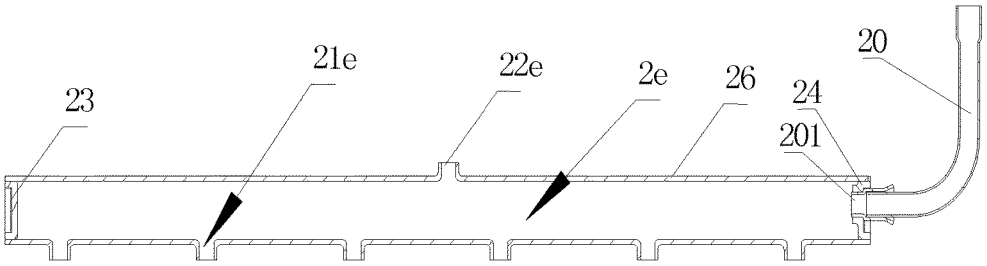
FIG. 2*a* is a transversely sectional schematic view showing the structure of another distributor shown in FIG. 1.

In addition, the distributor may also have the structure as shown in FIG. 2*a*, a main outlet 21*e* and a main body 26 of a distributor 2*e* may be formed integrally by the extrusion processing, moreover, a secondary outlet 22*e* and the main body 26 may also be formed integrally by the extrusion processing. Thus the joints and welding points can be reduced, which can further reduce the flow resistance of an inner wall at the main outlet 21*e*.

Figure 5:
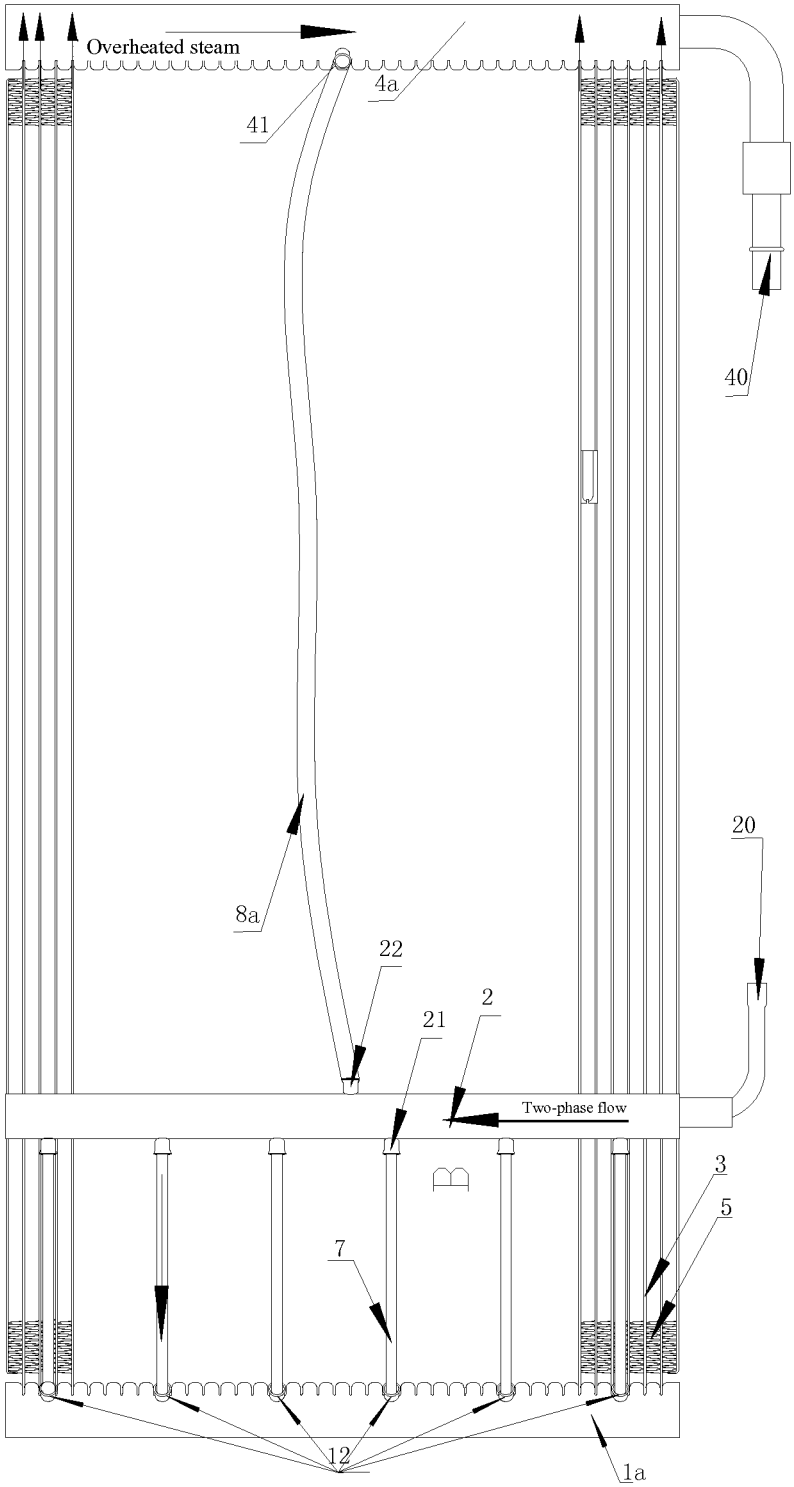
FIG. 5 is a schematic view showing the connection structure of a second embodiment of a micro-channel heat exchanger according to the present application.

A second embodiment of the present application is illustrated hereinafter, and reference is made to FIG. 5, which is a schematic view showing the connection structure of the second embodiment of a micro-channel heat exchanger according to the present application. The main differences between this embodiment and the above-described first embodiment are the structures of the first header and the second header. In this embodiment, a first header 1*a* is not provided with a partition and a second header 4*a* is provided with a secondary flow opening 41, and instead of being introduced into the first header, the fluid flowing from the secondary outlet 22 is introduced into the second header 4*a* located at an upper side by a secondary connecting pipe 8*a*. Specifically, the secondary flow opening 41 is arranged at the middle portion of the second header, or at a position between the middle portion and the other end of the second header that is far from the second port. In this way, the gaseous refrigerant flowing from the secondary outlet 22 on the upper side of the distributor 2 flows from the secondary connecting pipe 8*a* into the second header 4*a*. Since the second header is arranged in a relatively upward position, the secondary connecting pipe 8*a* is required to have a certain length, which can ensure that the refrigerant flowing from the secondary connecting pipe 8*a* into the second header 4*a* is basically gaseous refrigerant. This part of refrigerant has relatively high pressure, thus can be directly discharged from the second header 4*a*. In this way, it can also ensure that the refrigerant in the lower side of the distributor 2 is liquid refrigerant and the temperature thereof can be reduced. Although this part of gaseous refrigerant is directly discharged, the overall heat exchange effect may be improved on the contrary. In addition, a one-way valve (not shown) may be arranged in the connecting pipeline between the secondary outlet 22 and the secondary flow opening 41 of the second header 4*a*, to prevent the gaseous refrigerant in the second header 4*a* from flowing back to the distributor, and meanwhile prevent the refrigerant from directly entering into the distributor in the heating process without passing through the heat exchanger to exchange heat.

Figure 6:
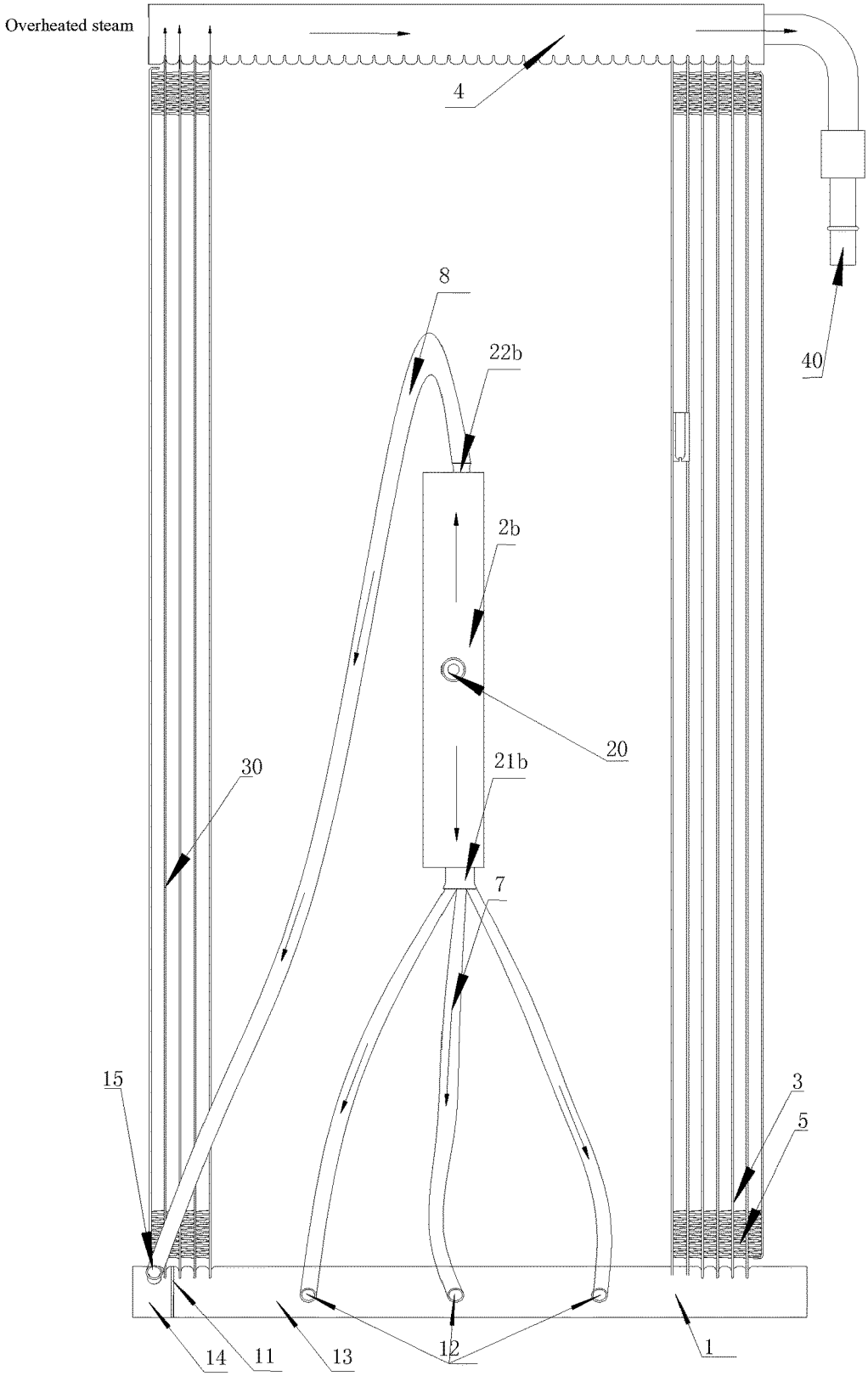
FIG. 6 is a schematic view showing the connection structure of a third embodiment of a micro-channel heat exchanger according to the present application.
Figure 7:
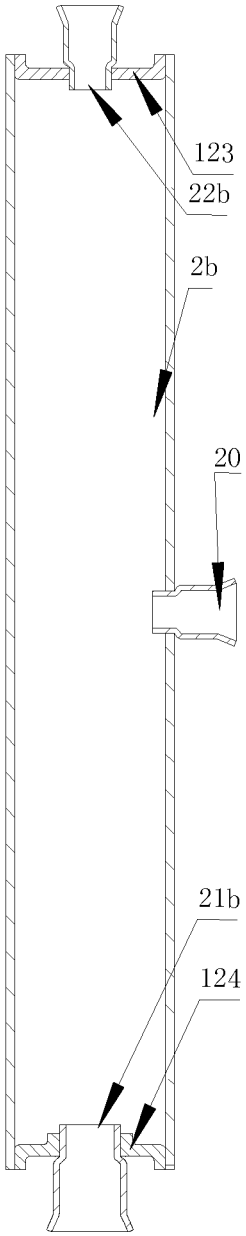
FIG. 7 is a sectional schematic view showing the structure of a distributor of the micro-channel heat exchanger shown in FIG. 6.

A third embodiment of the present application is introduced hereinafter, FIG. 6 is a schematic view showing the connection structure of the third embodiment of a micro-channel heat exchanger according to the present application, FIG. 7 is a sectional schematic view showing the structure of a distributor of the micro-channel heat exchanger shown in FIG. 6, and arrows inside the pipes shown in the figures are used to indicate the flow direction of refrigerant when the micro-channel heat exchanger is used as an evaporator. The micro-channel heat exchanger includes a first header 1 located at a lower side, a second header 4 located at an upper side, multiple sets of flat tubes 3 arranged between the first header 1 and the second header 4, and multiple sets of fins 5 arranged between the flat tubes 3. For clearly showing other parts in the Figures, only partial flat tubes and fins are illustrated in the Figures. A second port 40 is connected to the second header 4, the first header 1 is divided by a partition 11 into two sections, including a main header section 13 and an auxiliary header section 14, and the main header section 13 is provided with more than two main flow openings 12, and the auxiliary header section 14 is provided with at least one secondary flow opening 15. A distributor 2*b* is substantially longitudinally arranged, or obliquely arranged and substantially in parallel with the flat tubes, a main body of the distributor 2*b* is a longitudinal or oblique tubular structure, and in this embodiment, the main body of the distributor 2*b* is arranged substantially perpendicular to the first header 1, and the lowest end of the main body of the distributor 2*b* is higher than the highest end of the first header 1. A main outlet 21*b* connected to the main flow openings 12 is provided on the distributor 2*b* at a lower position, and the main flow openings 12 are connected to the main outlet 21*b* through multiple main connecting pipes 7, in this way, the distributor 2*b* is connected to the main header section 13 of the first header 1. In addition, an upper position of the distributor 2*b* is provided with at least one secondary outlet 22*b*, and the secondary outlet 22*b* is preferably arranged at the top position of the distributor 2*b*. The secondary outlet 22*b* is connected to the secondary flow opening 15 of the auxiliary header section 14 of the first header 1 through the secondary connecting pipe 8. A first end cover 123 and a second end cover 124 are respectively connected to two ends of the distributor 2*b* to seal the two ends.

An axial direction of a core of the heat exchanger is arranged vertically or obliquely upward, the distributor 2*b* is substantially vertically or obliquely arranged, and according to the embodiment in the Figures, the distributor 2*b* is arranged perpendicular to the first header 1. The distributor 2*b* may be placed on a windward side, a leeside or a lateral side of the core A of the heat exchanger, which can be determined according to the installation spatial position. The main flow openings 12 of the first header 1 are substantially distributed uniformly. In this way, when passing through the distributor 2*b*, gas-liquid two-phase refrigerant flowing from the first port 20 may be separated or substantially separated in the distributor 2*b* since the gravity of the liquid refrigerant is greater than that of the gaseous refrigerant, thus the liquid refrigerant is converged in a lower half of the distributor 2*b* relatively concentratedly and the gaseous refrigerant is basically concentrated in an upper space. In this way, most of the gaseous refrigerant concentrates in the top portion of the distributor 2*b* and then enters into the auxiliary header section 14 of the first header 1 from the secondary outlet 22*b* on the top portion through the secondary connecting pipe 8, and then are guided, through another part of the flat tubes 30 connected to the auxiliary header section 14 (fins may be provided at an outer surface of the flat tubes to increase the heat exchange area), to the second header 4 to be overheated. Under the action of the gravity, the liquid refrigerant is distributed into the multiple sets of main connecting pipes 7 through the main outlet 21*b* at the lower end of the distributor 2*b* and then enters into the main header section 13 of the first header 1, thus the refrigerant inside the main header section 13 is mainly liquid refrigerant, and the refrigerant distributed into the flat tubes 3 in communication with the main header section 13 is also mainly liquid refrigerant. Meanwhile, a partition 11 is provided to fully isolate the main header section 13 from the auxiliary header section 14 of the first header 1, so as to entirely separate the refrigerant in the main header section 13 from the refrigerant in the auxiliary header section 14, thus the problem of noises caused when the first header 1 distributing refrigerant is solved. The liquid refrigerant and gaseous refrigerant each pass through respective route in the heat exchanger to exchange heat, and are converged in the second header 4 and then flow out of the heat exchanger through the second port 40. Therefore, the effect of distributing the refrigerant uniformly can be realized, and meanwhile the problem of noises caused by the two-phase flow can also be overcame. The main differences between this embodiment and the above-described embodiments are the structure and installation manner of the distributor.

Figure 8:
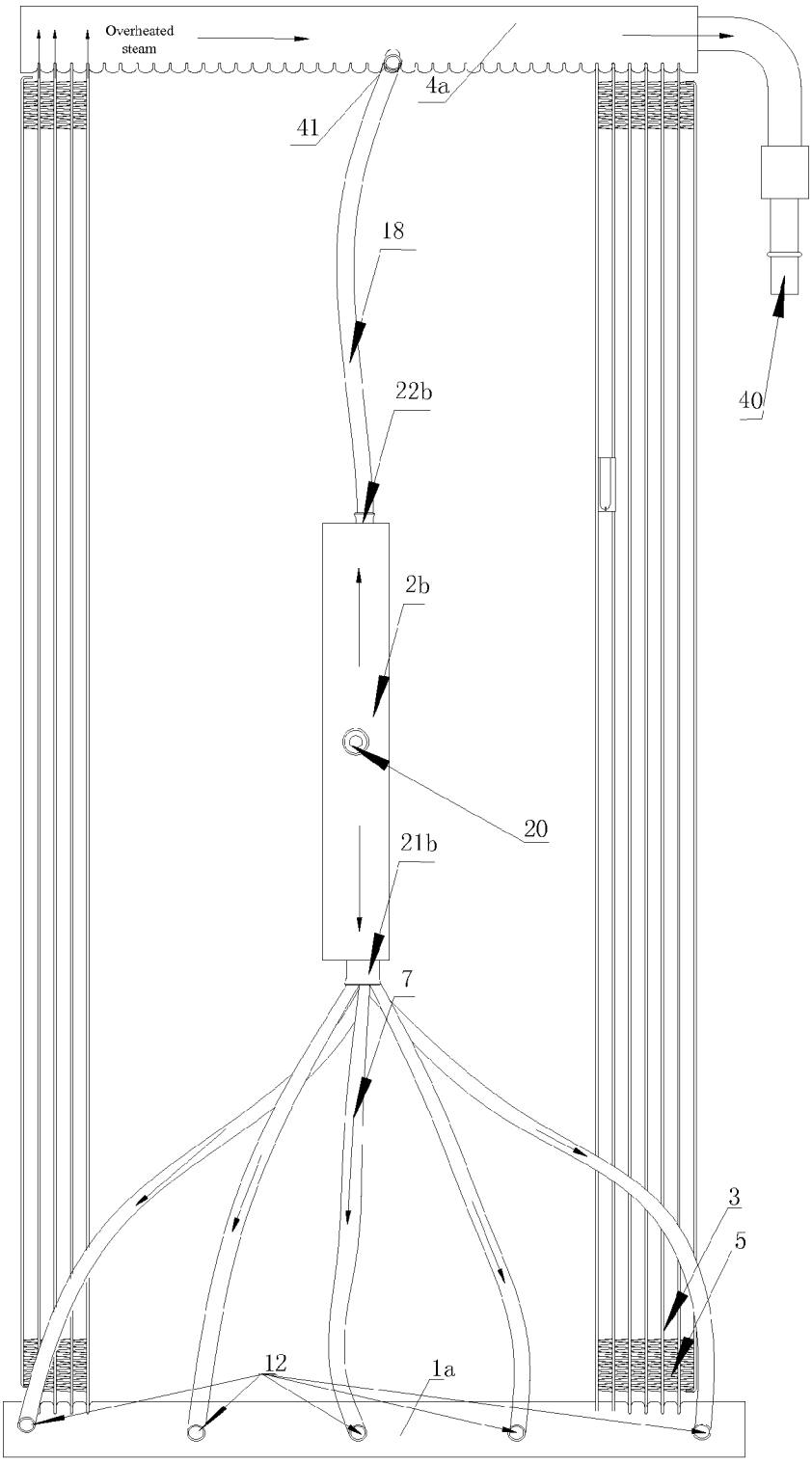
FIG. 8 is a schematic view showing the connection structure of a fourth embodiment of a micro-channel heat exchanger according to the present application.

Other connection manners may also be adopted when the substantially longitudinally arranged distributor is used. As shown in FIG. 8, which is a schematic view showing the connection structure of a fourth embodiment of a micro-channel heat exchanger according to the present application. The main differences between this embodiment and the above-described third embodiment are the structure of the first header and the connection manner of the secondary outlet of the distributor. In this embodiment, a first header 1*a* is not provided with a partition, a main outlet 21*b* at a lower end of a distributor 2*b* is connected to main flow openings 12 of the first header 1*a* via main connecting pipes 7, and a secondary outlet 22*b* at an upper end of the distributor 2*b* is connected to a secondary flow opening 41 of the second header 4*a* via a secondary connecting pipe 18. Similarly, a height of the lower end of the distributor 2 is preferably higher than a height of an upper end, in the height direction, of the first header 1*a*.

Figure 9:
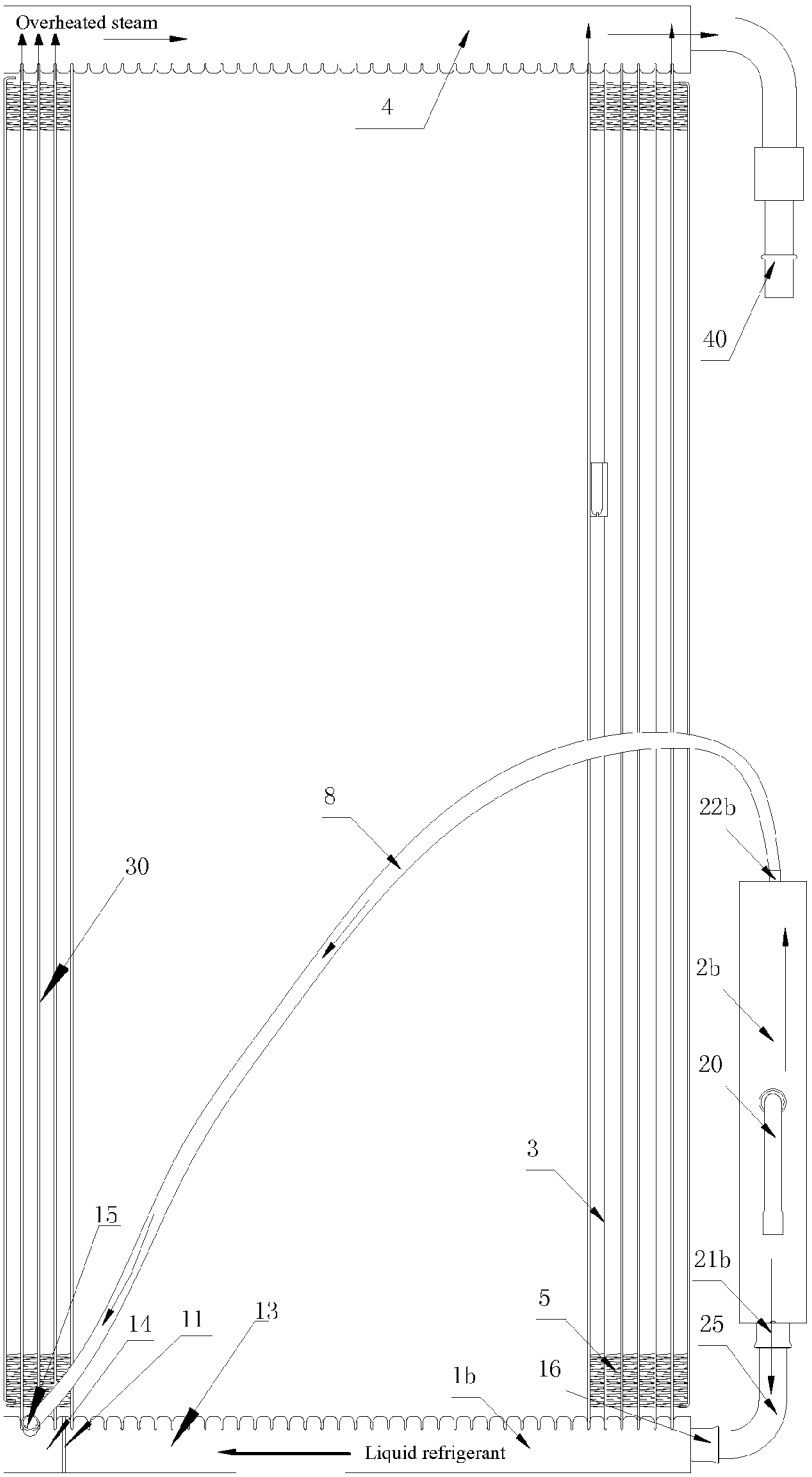
FIG. 9 is a schematic view showing the connection structure of a fifth embodiment of a micro-channel heat exchanger according to the present application.

Other installation and connection manners may also be adopted when the substantially longitudinally arranged distributor is used. As shown in FIG. 9, which is a schematic view showing the connection structure of a fifth embodiment of a micro-channel heat exchanger according to the present application. The micro-channel heat exchanger includes a first header 1*b* located at lower side, a second header 4 located at upper side, multiple sets of flat tubes 3 arranged between the first header 1*b* and the second header 4, and multiple sets of fins 5 arranged between the flat tubes 3. A second port 40 is connected to the second header 4, the first header 1*b* is divided by a partition 11 into two sections, including a main header section 13 and an auxiliary header section 14. The main header section 13 is provided with a main flow opening 16 which is arranged on a side opposite to the auxiliary header section 14, and the auxiliary header section 14 is provided with at least one secondary flow opening 15. The distributor 2*b* is substantially longitudinally arranged, and is arranged at a side portion of the core of the heat exchanger and is in parallel with the flat tubes 3 or forms a certain angle with respect to the flat tubes 3. A main outlet 21*b* connected to the main flow opening 16 is arranged on the distributor 2*b* at the position close to the lower side, and the main flow opening 16 is connected to the main outlet 21*b* by the main connecting pipe 25, and in this way, the distributor 2*b* is connected to the main header section 13 of the first header 1*b*. In addition, at least one secondary outlet 22*b* is arranged on the distributor 2*b* at the position close to the upper side, the main outlet 21*b* is lower than the inlet of the distributor and the secondary outlet 22*b* is higher than the inlet of the distributor. The secondary outlet 22*b* is preferably arranged at the top of distributor in the vertical direction, and the secondary outlet 22*b* is connected to a secondary flow opening 15 of the auxiliary header section 14 of the first header 1*b* by a secondary connecting pipe 8. This embodiment has the following advantages, the connection between the distributor and the first header is more easy and convenient, and welding points are reduced, and further, since the distributor is longitudinally arranged, the fluid flowing out of the main outlet 21*b* is mainly liquid refrigerant, and similarly, the refrigerant flowing into the first header 1*b* through the main connecting pipe 25 is also mainly liquid refrigerant, thus this embodiment can also uniformly distribute the refrigerant and overcome the problem of noises caused by the two-phase flow.

Figure 10:
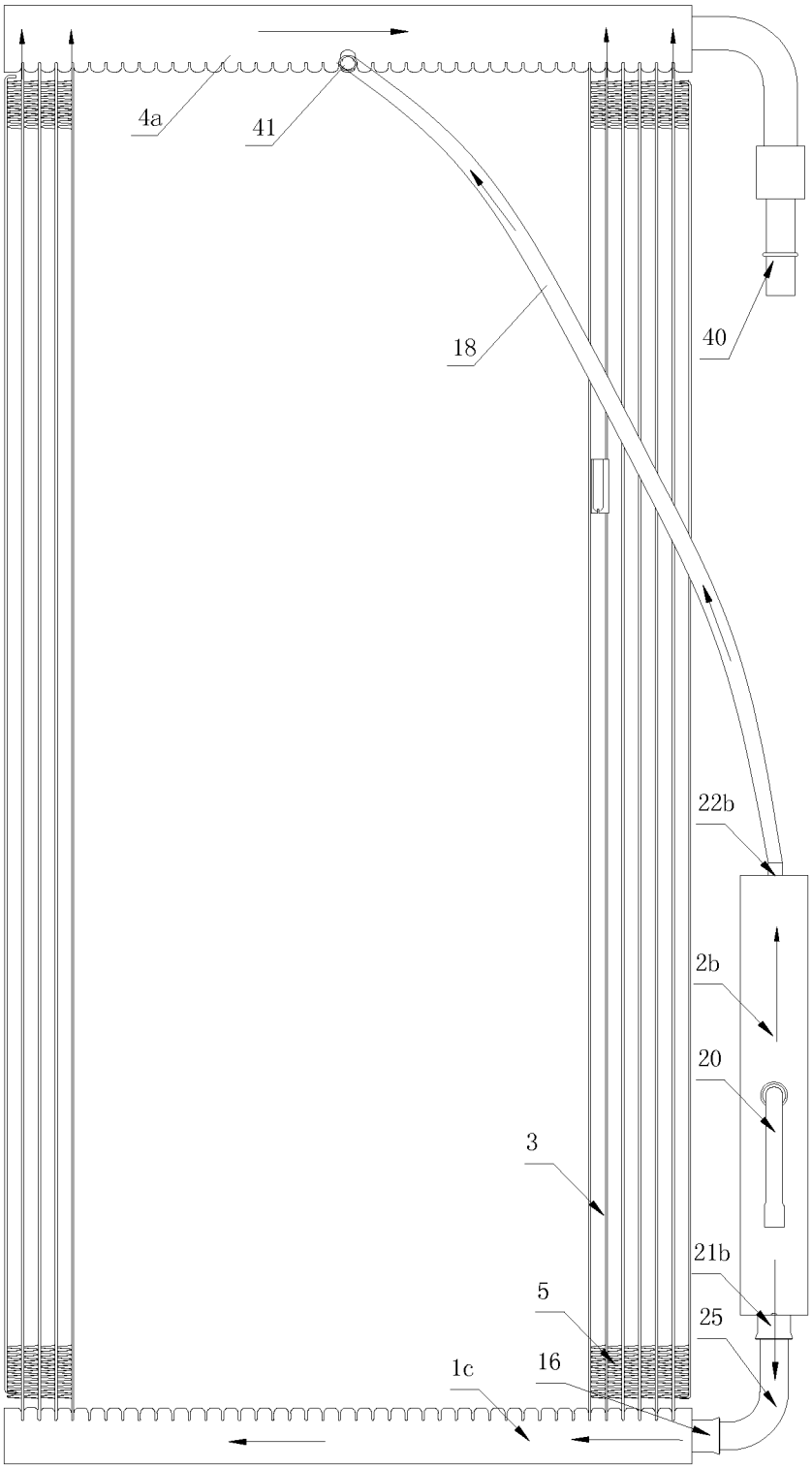
FIG. 10 is a schematic view showing the connection structure of a sixth embodiment of a micro-channel heat exchanger according to the present application.

In addition, the secondary outlet of the distributor may also be connected to the second header. As shown in FIG. 10, which is a schematic view showing the connection structure of a sixth embodiment of a micro-channel heat exchanger according to the present application. The main differences between this embodiment and the above-described fifth embodiment are the structure of the first header and the connection manner of the secondary outlet of the distributor. In this embodiment, a first header 1*c* is not provided with a partition, a main outlet 21*b* at a lower end of a distributor 2*b* is directly connected to a main flow opening 16 of the first header 1*c* by a main connecting pipe 25, and the fluid inside the first header 1*c* is mainly liquid refrigerant flowing from the lower end of the distributor 2*b*. A secondary outlet 22*b* at an upper end of the distributor 2*b* is connected to a secondary flow opening 41 of a second header 4*a* by a secondary connecting pipe 18, and a one-way valve may be provided on the secondary connecting pipe 18 to prevent the fluid from flowing back. Similarly, a height of the lower end of the distributor 2*b* is higher than a height of the first header 1*c*. The main flow opening 16 of the first header 1*c* is arranged at one end of the first header 1*c*, instead of being uniformly arranged on the first header.

Figure 11:
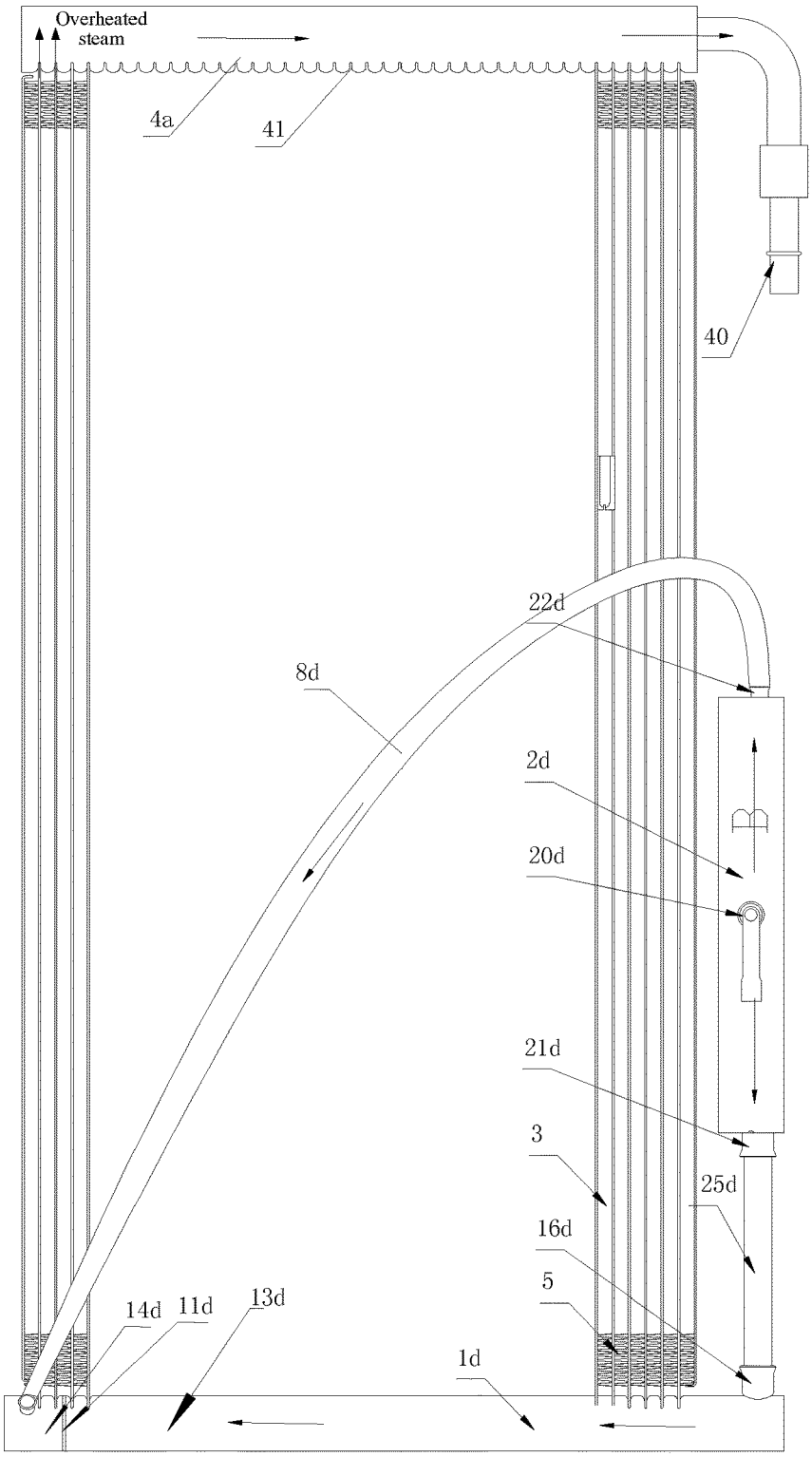
FIG. 11 is a schematic view showing the connection structure of a seventh embodiment of a micro-channel heat exchanger according to the present application.

In addition, the distributor and the first header may also be connected in other manners. As shown in FIG. 11, which is a schematic view showing the connection structure of a seventh embodiment of a micro-channel heat exchanger according to the present application. The main differences between this embodiment and the above-described fifth embodiment are the structure of the first header and the connection structure of the main outlet of the distributor and the first header. One end of a first header 1*d* that is close to a distributor 2*d* is provided with a connecting portion, and the connecting portion is not provided with flat tubes and is provided with a main flow opening 16*d*. A certain distance is provided between the main flow opening 16*d* and the flat tube closest to the main flow opening 16*d*, and the distance is greater than twice a distance between two adjacent flat tubes. The distributor 2*d* is also provided with a main outlet 21*d* at a lower end, a secondary outlet 22*d* at an upper end, and a first port 20*d* substantially at a middle thereof. The first header 1*d* is divided by a partition 11*d* into two sections, including a main header section 13*d* and an auxiliary header section 14*d*. The main outlet 21*d* of the distributor 2*d* is in communication with the main header section 13*d* by a main connecting pipe 25*d*, the secondary outlet 22*d* is in communication with the auxiliary header section 14*d* by a secondary connecting pipe 8*d*, and the auxiliary header section 14*d* is connected to a header 4*a* by one to two groups of flat tubes. The main connecting pipe 25*d* is arranged substantially perpendicular to the first header 1*d*, and an axis of the main connecting pipe 25*d* and an axis of the first header 1*d* may also be arranged to intersect with each other at angle of 30 degree to 150 degree. In this way, the pressure of the refrigerant doesn't change much in flowing into the first header 1*d*, since the refrigerant is flowing from the circular main connecting pipe 25*d* with a relative smaller inner diameter into the first header 1*d* with a relative larger inner diameter, thereby reducing the influence of vortex on several adjacent flat tubes.

Figure 12:
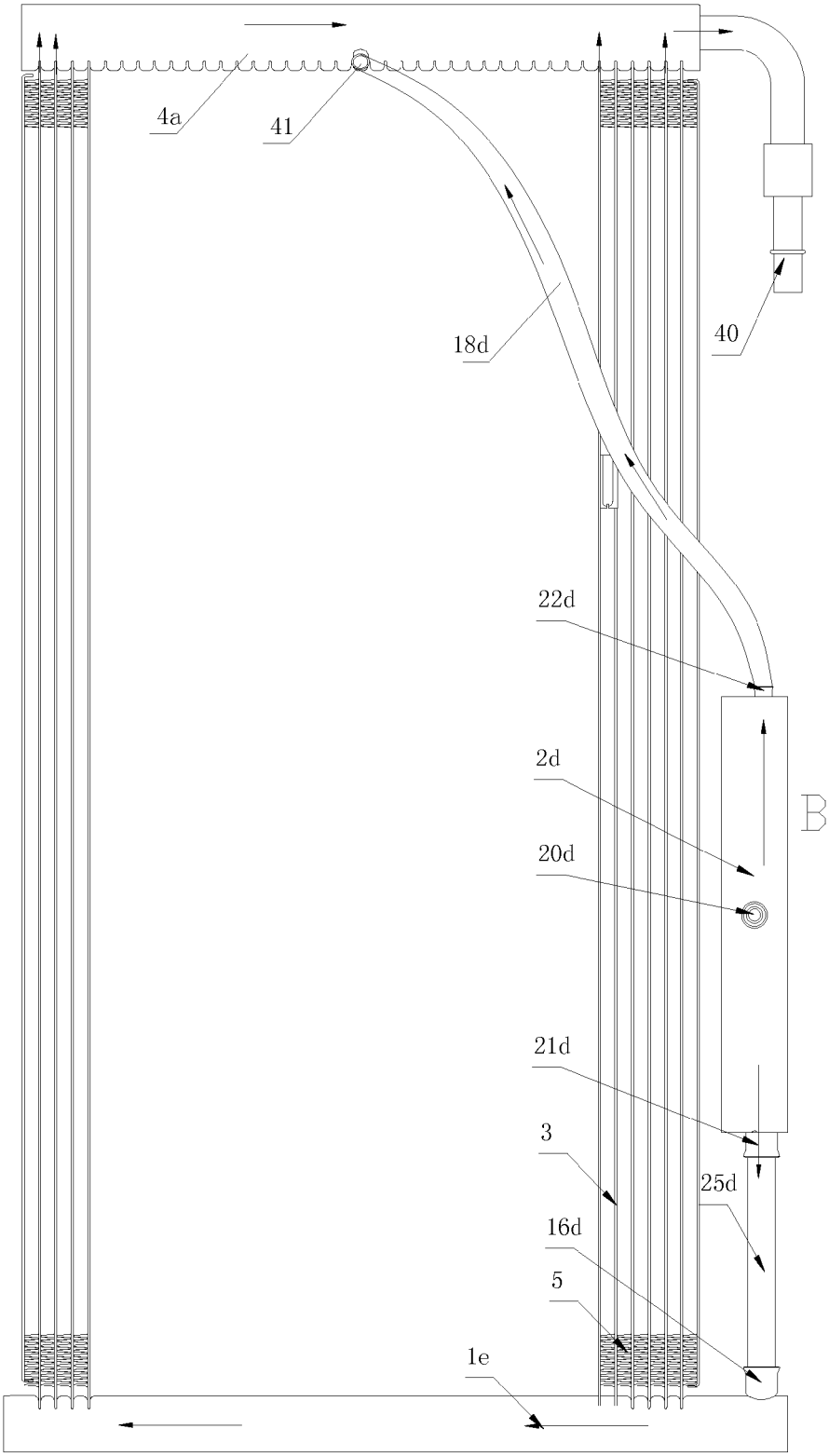
FIG. 12 is a schematic view showing the connection structure of an eighth embodiment of a micro-channel heat exchanger according to the present application.
Figure 13:
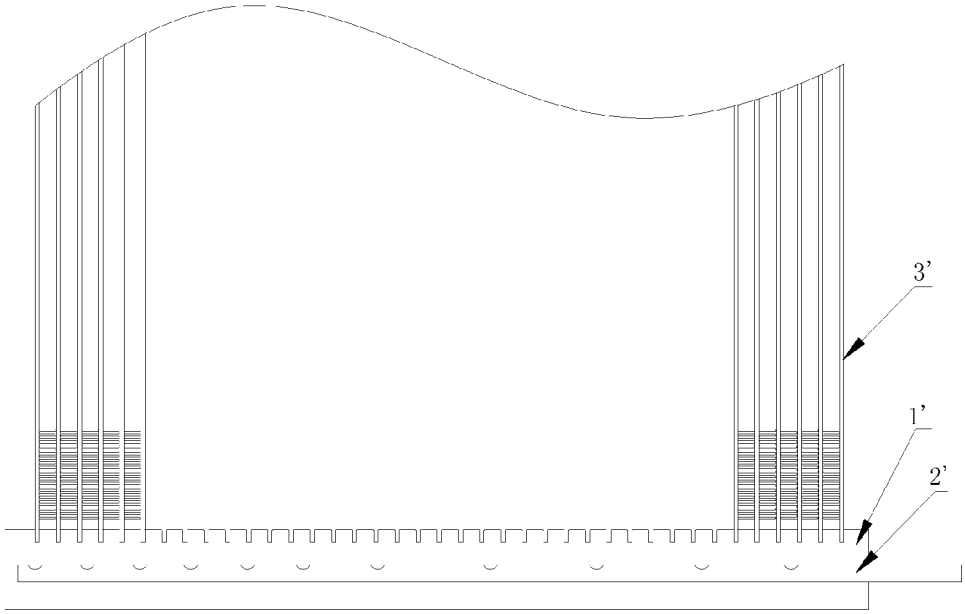
FIG. 13 is a schematic view showing the structure in the conventional technology.

Similarly, when such connection manner is employed, a secondary outlet of the distributor may also be directly connected to the second header. Reference is made to FIG. 12, which is a schematic view showing the connection structure of an eighth embodiment of a micro-channel heat exchanger according to the present application. The main differences between this embodiment and the seventh embodiment shown in FIG. 11 are as follows. In this embodiment, a first header 1*e* is not provided with a partition, a main outlet 22*d* of a distributor is connected to a secondary port 41 of a second header 4*a* by a secondary connecting pipe 18*d*. Connection and use of other parts may be referred to other embodiments described hereinabove, thus will not be described in details herein.

For the micro-channel heat exchange, sources of noises mainly include flowing sound and ejection sound of the refrigerant. Furthermore, for a micro-channel heat exchanger used as an evaporator, a two-phase refrigerant after passing through a throttle valve may generate an ejection sound while passing through a lower header. The ejection noise has features of high sound level, wide frequency band and far-distance transmission, and is generated by drastic gas disturbance caused by the high-speed airflow impacting and shearing surrounding static gas. Noises of ejection and cavitation will not exist when refrigerant in the bottom of the header is mainly liquid refrigerant, thereby solving the problem of the micro-channel heat exchanger that noises are generated in distributing the gas-liquid two-phase refrigerant.

Besides, in all the above-described embodiments, one distributor and one set of the core of heat exchange are used as a whole. When the heat exchanger has a large structure, such as the header has a long length, one set of micro-channel heat exchanger may be used in conjunction with two sets or multiple sets of distributors. Specifically, when multiple sets of distributors are employed, refrigerant passing through the multiple sets of distributors is introduced into multiple main flow openings of the first header through main outlets of the distributors respectively, and secondary outlets of the distributors are connected to secondary flow openings of the first header or the second header, thereby meeting the use requirement of relatively larger micro-channel heat exchangers. Other specific structures may be referred to the embodiments described above, which will not be described in details herein.

The above embodiments are only preferred embodiments of the present application, and are not intend to limit the present application in any form. Although the present application is disclosed hereinabove with the preferred embodiments, the preferred embodiments are not used to limit the present application. The nouns of locality in the specification, such as up and down, inside and outside, are only used for clear description and should not be regarded as limitation to the present application. It should be understood by the skilled in the art that, many possible variations and modifications, or equivalent embodiments modified as equivalent variations, such as combination or substitution of the above-described embodiments, may be made to the technical solution of the present application by using the above disclosed methods and technical contents without departing from the scope of the technical solution of the present application. Therefore, any simple variations, equivalent variations and modifications, made to above embodiments according to the technical essence of the present application without departing from the content of the technical solution of the present application, are also deemed to fall into the scope of the present application defined by the claims.

The invention claimed is:

1. A micro-channel heat exchanger, comprising:

a first header located at a lower side, a second header located at an upper side, a plurality of sets of flat tubes arranged between the first header and the second header, wherein the first header is divided by a partition into two sections, comprising a main header section and an auxiliary header section, wherein more than two flow openings are arranged at the main header section and a secondary flow opening is arranged at the auxiliary header section, wherein the main header section and the auxiliary header section are respectively connected to the second header by the plurality of sets of flat tubes; and a distributor located outside of the first header, wherein a main body of the distributor is of a tubular structure and is horizontally arranged, wherein the distributor comprises an inlet, a distributing chamber in communication with the inlet and configured to separate gas-phase refrigerant from liquid-phase refrigerant under an action of gravity, more than two main outlets in communication with the distributing chamber and disposed at a bottom of the distributor in a vertical direction, and at least one secondary outlet in communication with the distributing chamber and disposed at a top of the distributor in the vertical direction, and wherein, a central axis of the at least one secondary outlet and a central axis of each of the main outlets are vertical to a central axis of the distributor in a horizontal direction;

wherein a number of the main flow openings is same as a number of the main outlets of the distributor, the main outlets of the distributor are connected to the main flow openings of the first header by respective main connecting pipes to distribute a part of the refrigerant entering the distributing chamber of the distributor into the main header section of the first header through the main flow openings, wherein the at least one secondary outlet of the distributor is connected to the secondary flow opening by a secondary connecting pipe to distribute another part of the refrigerant entering the distributing chamber of the distributor into the auxiliary header section of the first header through the secondary flow opening, and a position where the distributor is located is higher than a position where the first header is located.

2. The micro-channel heat exchanger according to claim 1, wherein an axis of the main outlet of the distributor is oriented at an angle $\alpha$ with respect to an axis of the distributor in a vertical direction, and $60° \leq \alpha \leq 0°$; a center of the main flow opening of the first header is arranged at a position higher than a center of the first header in a height direction, and the main flow opening is located between two adjacent flat tubes; and the main outlet and the main body of the distributor form an integrated structure by extrusion processing.

3. The micro-channel heat exchanger according to claim 1, wherein the main body of the distributor is vertical or oblique to the first header or the second header the main outlet of the distributor is arranged at a position lower than a center of the main body of the distributor in a height direction, and the at least one secondary outlet of the distributor is arranged at a position higher than the center of the main body of the distributor in the height direction; the distributor is further provided with a first port connected to a system, and the first port is arranged at a lateral portion of a middle of the main body of the distributor; a height of the first port is higher than a height of the main outlet and lower than a height of the at least one secondary outlet.

4. The micro-channel heat exchanger according to claim 3, wherein both two ends or one of the two ends of the first header is provided with the main flow opening, the main outlet of the distributor is connected to the main flow opening at the end of the first header by the main connecting pipe, the height of the main outlet of the distributor is higher than a height of the main flow opening at the end of the first header; an axis of the main flow opening and an axis of the first header are arranged in parallel, or arranged perpendicular to each other, or arranged to form an angle ranging from 30 degree to 150 degree.

5. The micro-channel heat exchanger according to claim 1, wherein a length of the main header section is more than six times a length of the auxiliary header section.

6. The micro-channel heat exchanger according to claim 4, wherein the distributor is provided with the first port connected to the system, and the second header is provided with a second port connected to the system; a center of an inlet of the distributor, through which the first port is connected to the distributor, is higher than the center of the main body of the distributor in the height direction; and an interior equivalent diameter or an interior height D of the distributor and an interior equivalent diameter d of the main connect pipe satisfy an expression: $2 \leq D/d \leq 10$.

7. The micro-channel heat exchanger according to claim 1, wherein the distributor is arranged in parallel with the first header and is provided with at least three main outlets, and the main outlets and the main flow openings are respectively uniformly arranged at the distributor and the main header section of the first header in the horizontal direction.

8. The micro-channel heat exchanger according to claim 7, wherein in the secondary connecting pipe configured to connect the at least one secondary outlet to the secondary flow opening of the first header, at least a part of the secondary connecting pipe has a height higher than that of the distributor, and the height of the part of the secondary connecting pipe that is higher than the distributor is greater than or equal to an inner diameter or an interior height D of the distributor.

9. The micro-channel heat exchanger according to claim 1, wherein the number of the main flow openings arranged on the first header is less than or equal to a half of a number of flat tubes, in communication with the main flow openings, in the plurality of sets of flat tubes.

10. The micro-channel heat exchanger according to claim 2, wherein a length of the main header section is more than six times a length of the auxiliary header section.

11. The micro-channel heat exchanger according to claim 3, wherein a length of the main header section is more than six times a length of the auxiliary header section.

* * * * *